United States Patent [19]

Munyon et al.

[11] Patent Number: 4,690,053

[45] Date of Patent: Sep. 1, 1987

[54] ROLLER STAMP CONSTRUCTION

[75] Inventors: Gary D. Munyon, Concord; Matthew J. Swiech, Antioch, both of Calif.

[73] Assignee: G & B Rubber Stamp Co., Inc., Concord, Calif.

[21] Appl. No.: 799,257

[22] Filed: Nov. 18, 1985

[51] Int. Cl.[4] ..... B41F 5/00

[52] U.S. Cl. ..... 101/328; 101/405; 227/16

[58] Field of Search ..... 101/327, 328, 405, 415.1; 227/12, 13, 15, 16, 19, 24

[56] References Cited

U.S. PATENT DOCUMENTS

| | | | |
|---|---|---|---|
| 391,228 | 10/1888 | Burbank | 101/327 X |
| 403,822 | 5/1889 | Bartholomew | 101/328 X |
| 1,646,576 | 10/1927 | Castan | 101/327 X |
| 2,386,965 | 10/1945 | Lui | 101/405 X |
| 2,567,648 | 9/1951 | Marshall | 227/19 X |
| 2,666,916 | 1/1954 | Spiegel et al. | 227/12 |
| 2,694,874 | 11/1954 | Coolidge, Sr. et al. | 101/328 X |
| 2,905,085 | 9/1959 | Mercer et al. | 101/328 X |
| 3,050,786 | 8/1962 | St. John et al. | 101/327 X |
| 3,465,673 | 9/1969 | Oppenheim | 101/328 |
| 3,568,596 | 3/1971 | Mashburn | 101/415.1 |
| 4,007,680 | 2/1977 | Pfleger et al. | 101/328 X |

FOREIGN PATENT DOCUMENTS

| | | | |
|---|---|---|---|
| 292225 | 3/1932 | Italy | 101/405 |

*Primary Examiner*—Edgar S. Burr
*Assistant Examiner*—James R. McDaniel
*Attorney, Agent, or Firm*—Ernest M. Anderson

[57] ABSTRACT

A roller stamp is provided including a die roller to which is affixed a die strip formed of flexible plastic material which encircles the die roller, the ends thereof being adjacent or abutting, said die strip having a central embossed printing surface and recessed surface areas on either side thereof. The die strip is secured to the roller by means of a pair of staples that engage the adjacent ends of the die strip on both sides of the embossed printing surface within the recessed areas.

4 Claims, 3 Drawing Figures

ROLLER STAMP CONSTRUCTION

SUMMARY OF THE INVENTION

This invention relates generally to roller stamp constructions comprising a pair of rollers, one a die roller and the other an inking roller. The invention more particularly involves an improvement in a die strip formed of plastic material that is affixed to the die roller by means of a pair of staples. Conventional die rollers utilized die strips made of rubber which are affixed to the rollers solely by an adhesive. But this has proven unsatisfactory insofar as mounting die strips made of plastic, especially those plastics which give long die life and a superior quality of imprint.

A primary object of this invention is to provide an improved roller stamp construction including means for affixing a die strip formed of flexible plastic material to the die roller.

Another object is to provide an inexpensive as well as useful means for affixing plastic die strips to a die roller.

Other objects of this invention will become apparent in view of the following detailed description and the accompanying drawings.

In the drawings forming a part of this application in which like parts are identified by like reference numerals:

Figure 1:
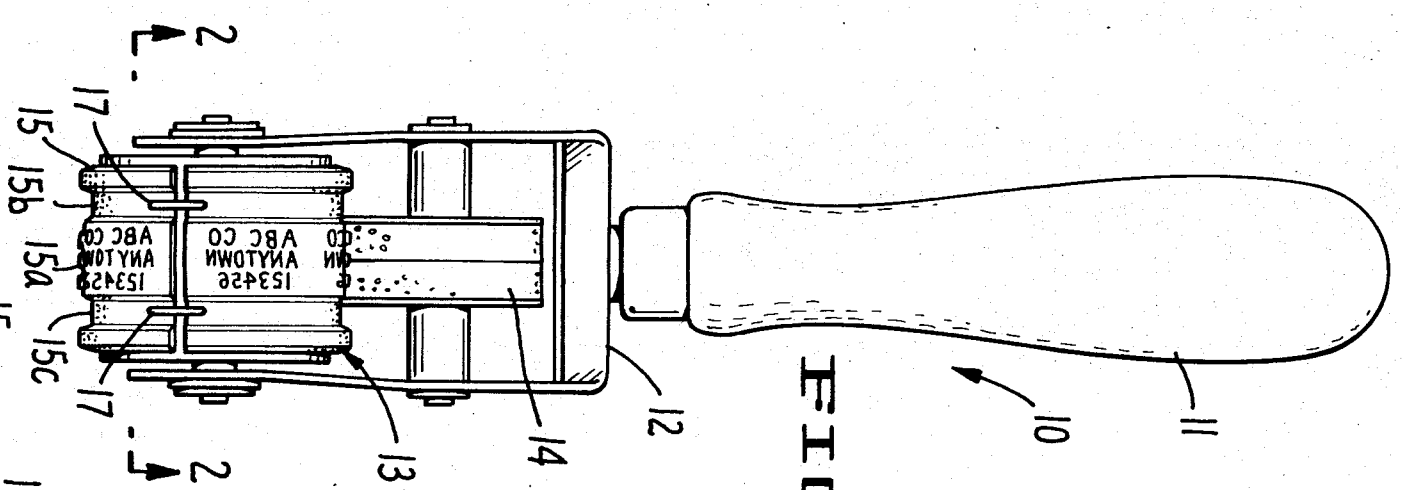
FIG. 1 is an end view of a roller stamp that embodies the invention.
Figure 3:
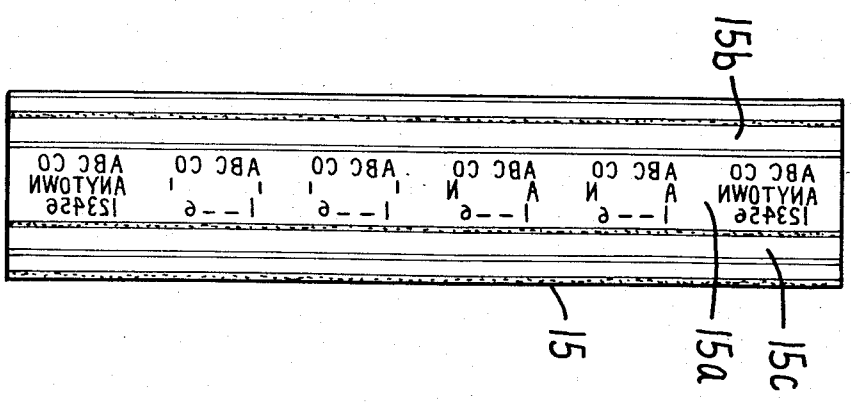
FIG. 3 is a plan development or layout of the die strip affixed to the die roller.
Figure 2:
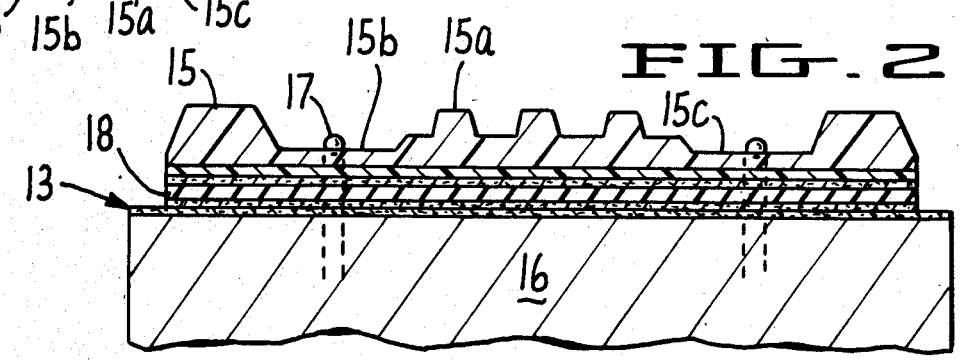
FIG. 2 is an enlarged partial section through the die roller of said roller stamp.

Referring to the drawings, there is illustrated a preferred embodiment of the invention in a roller stamp 10 comprising a handle 11, a support frame 12 mounted from one end of the handle, a die roller 13 and an inking roller 14. Rollers 13 and 14 are mounted on parallel axes between side plates of the frame. In the conventional manner, the die roller carries a die strip 15 mounted to the cylindrical surface of a wooden core 16. The die strip is formed of a flexible plastic having a central embossed printing surface 15*a*, and recessed surface areas 15*b* and 15*c* on either side thereof. The die strip is secured to the wooden core 16 by means of a pair of staples 17, each staple being secured to adjacent ends of the die strip and to wooden core 16, one staple being within the recessed area 15*b* and the other within recessed area 15*c*.

A preferred embodiment of the invention utilizes a flexible plastic die strip, made of material such as Cyrel which has a Mylar backing. A layer of adhesive rubber 18 is applied to the Mylar backing for initially mounting the die strip to the wooden core 16. In addition, the exterior surface of wooden core 16 is preferably sealed with an adhesive spray.

Although a preferred embodiment of the invention has been illustrated and described, various modifications and changes may be resorted to without departing from the spirit of the invention or the scope of the appended claims and each of such modifications and changes is contemplated.

What is claimed is:

1. A roller stamp for imprinting sheet material with indicia, said stamps having a handle, a support frame mounted from one end of said handle, and a pair of rollers rotatably mounted on parallel axes from the frame, one of said rollers being a die roller, said roller being formed of wood, the other roller being an inking roller, the improvement comprising: a die strip formed of flexible plastic material that encircles the die roller, the ends thereof being adjacent or abutting, said die strip having a central embossed printing surface and recessed surface areas on either side thereof; and a pair of staples that engage the adjacent ends of said die strip within said recessed areas, each staple comprising a pair of legs that project substantially perpendicular to a connecting member, one leg of each staple being engaged with one end of said die strip and embedded in said die roller, the other leg of each staple being engaged with the other end of said die strip and embedded in said die roller.

2. The roller stamp of claim 1, said die strip having a Mylar backing adhesively affixed to said die roller.

3. The roller stamp of claim 2, said die strip being adhesively affixed by a layer of adhesive rubber sandwiched between said Mylar backing and said die roller.

4. The roller stamp of claim 1, the exterior surface of said roller being sealed by an adhesive spray.

* * * * *